United States Patent [19]

Griffiths et al.

[11] 4,410,616

[45] Oct. 18, 1983

[54] MULTI-LAYERED AMBIPOLAR PHOTORESPONSIVE DEVICES FOR ELECTROPHOTOGRAPHY

[75] Inventors: Clifford H. Griffiths, Pittsford; Andrew R. Melnyk, Rochester, both of N.Y.

[73] Assignee: Xerox Corporation, Stamford, Conn.

[21] Appl. No.: 376,078

[22] Filed: May 10, 1982

[51] Int. Cl.[3] ..... G03G 5/14

[52] U.S. Cl. ..... 430/59; 430/902; 430/46; 430/945

[58] Field of Search ..... 430/58, 59, 46, 902

[56] References Cited

U.S. PATENT DOCUMENTS

| | | | |
|---|---|---|---|
| 3,677,751 | 7/1972 | Qhta et al. | 96/1 R |
| 3,719,481 | 3/1973 | Makino et al. | 96/1 R |
| 3,775,104 | 11/1973 | Matsumoto et al. | 96/1 R |
| 3,992,204 | 11/1976 | Taylor | 96/1.5 |
| 4,189,224 | 2/1980 | Sakai | 355/4 |
| 4,232,103 | 11/1980 | Limburg et al. | 430/58 X |
| 4,264,695 | 4/1981 | Kozima et al. | 430/900 X |
| 4,341,851 | 7/1982 | Mooney et al. | 430/58 X |

*Primary Examiner*—John D. Welsh
*Attorney, Agent, or Firm*—E. O. Palazzo

[57] ABSTRACT

This invention is directed to an improved ambipolar photoresponsive device useful in imaging systems for the production of positive images, from either positive or negative originals, which device is comprised of:

(a) supporting substrate,
(b) a first photogenerating layer,
(c) a charge transport layer, and
(d) a second photogenerating layer, wherein the charge transport layer is comprised of a highly insulating organic resin having dissolved therein small molecules of an electrically active material of the formula:

wherein X is selected from the group consisting of alkyl and hal

24 Claims, 3 Drawing Figures

MULTI-LAYERED AMBIPOLAR PHOTORESPONSIVE DEVICES FOR ELECTROPHOTOGRAPHY

BACKGROUND

This invention is generally directed to layered photoresponsive devices, and more specifically, the present invention is directed to an improved layered photoresponsive device comprised generally of a transport layer situated between two photogenerating layers. The layered photoresponsive devices of the present invention are useful as imaging members in various electrostatographic imaging systems, including those systems wherein electrostatic latent images are formed on the imaging member. Additionally, the photoresponsive devices of the present invention can be initially charged positively or negatively, and development can be accomplished by employing the appropriately charged developer composition, thus, for example, when the device is charged negatively, a developer composition is employed wherein the toner material is charged positively.

Numerous photoresponsive devices for electrostatographic imaging systems are known including selenium, selenium alloys, such as arsenic selenium alloys; layered inorganic photoresponsive devices, and layered organic photoresponsive devices. Examples of layered organic photoresponsive devices include those containing a charge transporting layer and a charge generating layer. Thus, for example, an illustrative layered organic photoresponsive device can be comprised of a conductive substrate, overcoated with a charge generating layer, which in turn is overcoated with a transporting layer. In a further variation of this device, the charge transporting layer can be overcoated with the photogenerating layer. Examples of generating layers that can be employed in these devices include pigments such as selenium, cadmium sulfide, vanadyl phthalocyanine, x-metal free phthalocyanines, dispersed in binder resins, while examples of transport layers include dispersions of various diamines, reference, for example, U.S. Pat. No. 4,265,990, the disclosure of which is totally incorporated herein by reference.

There nevertheless continues to be a need for improved photoresponsive devices, and improved imaging systems utilizing such devices. Additionally, there continues to be a need for photoresponsive devices of varying sensitivity, which devices are economical to prepare and retain their properties over extended periods of time. Furthermore there continues to be a need for photoresponsive devices that permit both normal and reverse copying of black and white images. An example of such an application resides in the production of a positive (black on white background) image copy from a negative (white on black background) original, such as a silver halide microfilm system wherein positive copies result from negative originals. This process can be accomplished by using two developers with toner compositions of opposite polarity as known in the art, however these systems are complex, and thus costly. It would thus be desirable to provide a system wherein there is utilized a single developer composition with a photoresponsive device that can be charged either positively or negatively. This requires an ambipolar photoresponsive device, which device contains materials that permit the photogeneration, and transport of both positive and negative charge that is, holes and electrons.

OBJECTS OF THE INVENTION

It is an object of the present invention to provide a photoresponsive device, and imaging method, which overcomes some of the above-noted disadvantages, and allows ambipolar electrophotography.

A further object of the present invention is the provision of a four layered photoresponsive device containing four or more layers, and a method of imaging utilizing such a device.

Another object of the present invention is the provision of a photoresponsive device comprised of a charge transport layer situated between two photogenerating layers.

These and other objects of the present invention are accomplished by providing an improved ambipolar layered photoresponsive device, useful in imaging systems for the production of positive images from either positive or negative originals, which device is comprised in the order stated of (1) a supporting substrate, (2) a first charge photogenerating layer, (3) a charge transport layer, and (4) a second charge photogenerating layer. The charge (hole) transport layer is thus situated between the two charge photogenerating layers, thus the first photogenerating layer is in operative contact with the charge transport layer, and the second photogenerating layer is also in operative contact with the charge transport layer. In one embodiment of the present invention the supporting substrate can be electrically conductive or non-conductive, and the photogenerating layers can be comprised of the same materials, or may be comprised of different materials as detailed hereinafter. In another embodiment of the present invention, appropriate charge blocking layers, such as aluminum oxide, may be situated between the supporting substrate, and the first charge photogenerating layer; and further such charge blocking layers can be selected as a top coating over the second charge photogenerating layer. Additionally, in those situations when the supporting substrate is non-conductive, a conductive layer is normally incorporated between the supporting substrate and the first charge photogenerating layer.

A method of imaging utilizing the above photoresponsive device is also embraced within the scope of the present invention.

BRIEF DESCRIPTION OF THE DRAWINGS

For a better understanding of the present invention and further features thereof, reference is made to the following detailed description of various preferred embodiments wherein.

DESCRIPTION OF THE PREFERRED EMBODIMENTS

Figure 1:
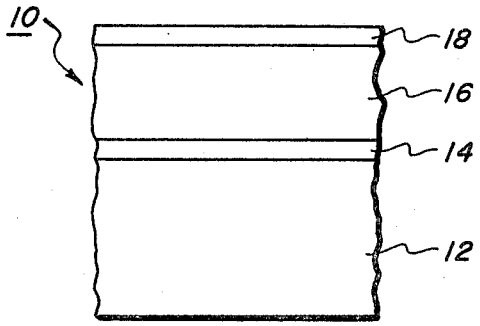
FIG. 1 is a partially schematic cross sectional view of the photoreceptor device of the present invention.

Illustrated in FIG. 1 is the photoreceptor device of the present invention generally designated 10 comprising a substrate 12, a photogenerating layer 14, a transport layer 16, and a photogenerating layer 18. Substrate 12 may be opaque, or substantially transparent, and may comprise various suitable materials possessing the requisite mechanical properties. The substrate may thus be comprised of a layer of non-conducting material, such as an inorganic or organic polymeric materials, having a conductive surface layer arranged thereon, such as aluminized Mylar, commercially available, or a conductive material such as, for example, aluminum, brass or the like. The substrate may be flexible or rigid and may have any of many different configurations such as, for example, a plate, a cylindrical drum, a scroll, an endless flexible belt, and the like.

The thickness of the substrate layer depends on many factors, including economic considerations, thus this layer may be of substantial thickness, for example, over 100 mils, or of minimum thickness providing the objectives of the present invention are achieved. In one preferred embodiment the substrate thickness ranges from about 3 mils, to about 10 mils.

The photogenerating layer 14 can be comprised of numerous suitable materials, providing for example that these materials allow the injection of photoexcited charge carriers into the transport layer. Illustrative examples of such materials include amorphous selenium, selenium arsenic alloys, selenium tellurium alloys, halogen doped selenium compositions, halogen doped selenium alloys, phthalocyanines, such as the x-form of metal free phthalocyanine, metal phthalocyanines, such as zinc phthalocyanine, other phthalocyanines such as vanadyl phthalocyanine, squaraines, cadmium compounds of sulfur, selenium, and tellurium, chlozodiane blue, thiapyrilium, and the like. These materials can be used alone, or as a dispersion in a polymeric binder, including those disclosed in U.S. Pat. No. 3,121,006, the disclosure of which is totally incorporated herein by reference. A preferred photogenerating layer 14, is comprised of a pigment of vanadyl phthalocyanine, dispersed in a resin binder such as a polyester resin, wherein the percentage of the phthalocyanine present ranges from about 8 percent to about 100 percent, and preferably from about 8 percent to about 30 percent.

Generally layer 14 ranges in thickness of from about 0.05 microns to about 10 microns, and preferably from about 0.1 microns to about 3 microns, it being noted that the optimum thickness of this layer is dependent on a number of factors, including mechanical considerations, the degree of photosensitivity desired, and the like.

The photogenerating overcoating layer 18 can be comprised of the same materials as photogenerating layer 14, providing that this layer is partially absorbing and allows some of the incident light to pass through the transport layer 16 to the generating layer 14. Accordingly, the photogenerating layer 18 can be comprised of the same materials described herein for the photogenerating layer 14, or it may be comprised of different materials. Illustrative examples of materials useful in layer 18 include amorphous selenium, selenium arsenic alloys, selenium tellurium alloys, trigonal selenium, metal free phthalocyanines such as the x-form of metal free phthalocyanine, metal phthalocyanines, other phthalocyanines such as vanadyl phthalocyanine, squarilium dyes, thiapyrilium pigments, and the like. A prefered photogenerator layer 18, is comprised of an arsenic selenium alloy, wherein the percentage of selenium present ranges from about 60 weight percent to about 100 weight percent and the percentage of arsenic ranges from about 40 weight percent to about 0 weight percent, with the preferred range of selenium being from about 60 weight percent to about 70 weight percent, and the preferred range of arsenic being from about 30 weight percent to about 40 weight percent. As with layer 14, this layer can be comprised of the materials indicated, or layer 18 can contain a dispersion of such photogenerating substances.

Generally layer 18 ranges in thickness of from about 0.05 microns to about 2 microns, and preferably is of a thickness of from about 0.1 microns to about 1.0 microns, however, the exact thickness of this layer depends on a number of factors, including the degree of optical absorption.

The hole transport layer or charge carrier transport layer 16, can be comprised of a number of suitable materials which are transparent to light, and are capable of transporting holes, this layer having a thickness in the range of from about 5 microns to about 50 microns, and preferably from about 10 microns to about 30 microns. In one embodiment, this layer is comprised of a highly insulating organic resin, such as those disclosed in U.S. Pat. No. 3,161,006, and preferably a polycarbonate resin, having dissolved therein small molecules of an electrically active material. In one preferred embodiment, the transport layer comprises molecules of the formula

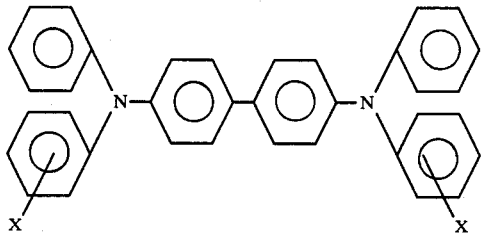

dispersed in a highly insulating and transparent organic resinous material, wherein X is selected from the group consisting of alkyl, and halogen, and preferably (ortho) $CH_3$, (meta) $CH_3$, (para) $CH_3$, (meta) Cl, (ortho) Cl or (para) Cl, reference U.S. Pat. Nos. 4,251,612 and 4,265,990, the teachings of which are totally incorporated herein by reference. This layer is substantially non-absorbing in the spectral region of intended use, i.e., visible light, but it allows the injection of photogenerated holes from the charge photogenerating layers. The highly insulating resin, employed has a resistivity of at least $10^{12}$ ohm-cm, to prevent undue dark decay, and is a material which is not necessarily capable of supporting the injection of holes from the generator layer, and is not capable of allowing the transport of these holes through the material. However, the resin becomes electrically active when it contains from about 10 to 75 weight percent of the substituted, N,N,N',N'-tetraphenyl-[1,1'-biphenyl] 4-4'-diamines corresponding to the foregoing formula. Substances corresponding to this formula include, for example, N,N'-diphenyl-N,N'-bis(alkylphenyl)-[1,1'-biphenyl]-4,4'-diamine, wherein the alkyl is selected from the group consisting of methyl such as 2-methyl, 3-methyl and 4-methyl, ethyl, propyl, butyl, hexyl and the like. With chloro substitution, the substance is N,N'-diphenyl-N,N'-bis(halo phenyl)-[1,1'-biphenyl]-4,4'-diamine, wherein the halo atom is 2-chloro, 3-chloro or 4-chloro.

Other electrically active small molecules which can be dispersed in the electrically inactive resin to form a layer which will transport holes include triphenylmethane, bis-(4-diethylamino-2-methylphenyl) phenylmethane; 4',4''-bis(diethylamino)-2',2''-dimethyltriphenyl methane; bis-4(-diethylamino phenyl) phenylmethane; and 4,4'-bis(diethylamino)-2,2'-dimethyltriphenylmethane.

Generally from about 10 percent to about 75 percent by weight of the active diamine, and preferably from about 30 percent to about 50 percent by weight, are dispersed in the resinous binder.

In one preferred embodiment, the photoresponsive device of the present invention is comprised of a transport layer in a thickness of about 20 microns, consisting of N,N,N',N'-tetraphenyl[1,1'-biphenyl]-4-4'-diamine dispersed in the polycarbonate commercially available as Lexan.

Figure 2:
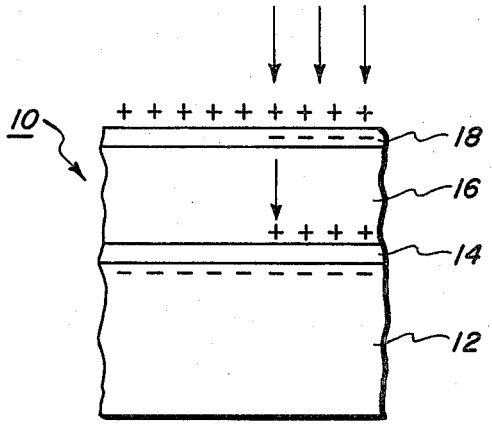
FIGS. 2, and 3, illustrate the various imaging method steps employed utilizing the improved photoreceptor device of the present invention.

The photoresponsive device of the present invention can be employed in numerous imaging systems particularly xerographic imaging systems, wherein latent images are formed on the surface of the device of the present invention. In these systems, the photoresponsive device of the present invention can either be charged negatively or positively. Thus, for exammple, as illustrated in FIG. 2, the top surface of the photoresponsive device of FIG. 1 can be charged positively, causing the then illuminating photons, which are absorbed in the generating layer 18 to generate hole electron pairs. Under the influence of an applied field, the holes are injected into the transport layer 16, and migrate down toward the support substrate 12, causing a collapse in the field. The photons passing through the photoresponsive device structure to generating layer 14 also generate charge carriers, however, because of the field polarity, these charge carriers remain localized as shown, and do not participate in the imaging process.

Figure 3:
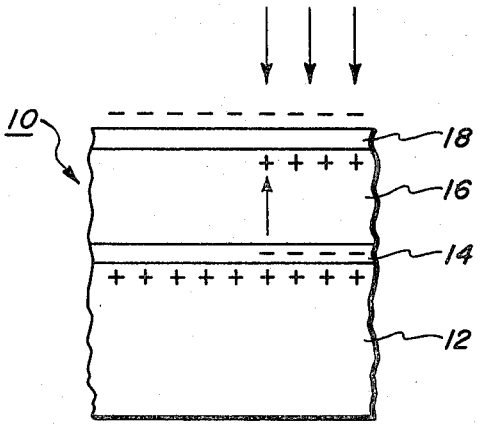

As shown in FIG. 3, the photoresponsive device of FIG. 1 can also be charged negatively, wherein holes which are generated in generating layer 18 remain localized, however holes generated in generating layer 14 are injected into the hole transport layer 16, and migrate up causing a collapse in the field in the illuminated areas.

Accordingly, there is embraced within the present invention a method of imaging, which comprises forming an electrostatic latent image on a photoresponsive device described herein, and comprised of a supporting substrate, a photogenerating layer in contact therewith, a transport layer, and a photogenerating overcoating layer, wherein the image is formed by positively charging the imaging surface, or negatively charging the imaging surface, followed by development of the image, transfer to a permanent substrate, such as plain bond paper and optinally fixing the image by heat.

Developer compositions comprised of toner particles and carrier particles can be utilized for causing the development of the images contained on the photoresponsive device of the present invention. The developing composition can contain toner particles, charged positively or negatively, or both depending on the development desired, that is, regular development and/or reversal development. The charge on the toner particles can be obtained by employing charge enhancing agents, for example, such as quaternary ammonium compounds, or alkyl pyridinium halides, reference U.S. Pat. No. 4,298,672, the disclosure of which is totally incorporated herein by reference, when a positive charge is desired on the toner particles, or by utilizing coatings for the carrier particles causing these particles to charge positively, and the toner particles to charge negatively.

Illustrative examples of toner particles that may be utilized in the present invention include toner resins containing therein a suitable colorant or pigment such as carbon black, these resins being for example polyamides, epoxies, polyurethanes, vinyl esters, and polyesters, especially those prepared from dicarboxylic acids and diols comprising diphenol. Various suitable vinyl resins may be employed including homopolymers or copolymers of two or more vinyl monomers, examples of such vinyl monomers including styrene, vinyl naphthalene, ethylene, propylene, butylene, and the like, vinyl halide such as vinyl chloride, and vinyl bromide, vinyl esters such as vinyl acetate, esters of alpha methylene aliphatic mono carboxylic acids such as methylacrylate, ethylacrylate, and butylacrylate, methylmethacrylate, ethylmethacrylate, butylmethacrylate, and the like. Generally preferred are resins containing a relatively high percentage of styrene. Further, esterification products of a dicarboxylic acid and a diol comprising a diphenol may be used as the resin material for the toner composition of the present invention, these materials being illustrated in U.S. Pat. No. 3,655,374, the disclosure of which is totally incorporated herein by reference.

Optimum electrophotographic resins used for the toner composition of the present invention include styrene butylmethacrylate copolymers, styrene vinyl toluene copolymers, styrene acrylate copolymers, polyester resins, or polystyrene base resins as generally described in U.S. Pat. No. Re. 25,136, polystyrene blends as described in U.S. Pat. No. 2,788,288, and styrene butadiene resins.

Illustrative examples of carrier materials that are employed together with the toner particles for the purpose of forming the developer compositions to be utilized in the present invention, include those carrier particles that are capable of imparting a negative triboelectric charge, and a positive triboelectric charge to the respective toner compositions, such carrier particles including steel, nickel, iron ferrites, silicon dioxide, polymeric materials such as methylmethacrylate, and the like. Such carriers can be used with or without a coating, the coatings generally containing polyvinylidene fluoride resins, polymethacrylate copolymers, and the like. Illustrative examples of typical carrier materials that can be employed are described for example in U.S. Pat. Nos. 3,353,835, 3,591,503, 3,618,522, and 3,526,553.

The photoresponsive device of the present invention is psuedoambipolar, that is, it can be either charged negatively or positively, and subsequently can be discharged by illumination. Such a unique property allows the production of either a positively or negatively charged image on the surface of the photoresponsive device of the present invention, thus, if positive originals are desired, the photoresponsive device of the present invention is charged positively, and the non-discharged areas are developed as in conventional xerography, while for negative originals, the photoresponsive device of the present invention is charged negatively and the discharged areas are developed as in conventional xerography but wherein the device is suitable biased in order to allow proper development to occur.

An illustrative application of the photoresponsive device of the present invention is in a machine environment wherein positive prints (black marks on white background) are obtained from both positive and negative originals. Accordingly, a useful machine may be a copier/microfilm printer where a negative film is utilized.

In another application the photoresponsive device of the present invention can be employed in a copier/laser printer. In the printing mode, the laser writes the images, and the discharged areas are developed, the advantage being that the spectral response of the photoreceptor can be independently optimized for the laser, and the copying light. Generating materials, such as phthalocyanines, which are sensitive in the infra-red, are unsuitable for copying with very broad band lights (such as incandescent or xenon lamps). By placing such a generating material in contact with a substrate, and utilizing as the top generating layer, layer 18, a material such as $As_2Se_3$, the photosensitive device is sensitive to visible light, (400–700 nm) when charged positively, however when charged negatively it is sensitive only to red light.

In a further embodiment, the ambipolar photoresponsive device of the present invention can be selected for use in a two color imaging system. This can be accomplished by selecting a first photogenerating layer and a second photogenerating layer that absorb light in different portions of the spectrum, thereby allowing the positive and negative charge images to form different color originals. Thus, for example, when photogenerating layer 14 is a red light sensitive materials, such as a phthalocyanine, and photogenerating layer 18 is a blue light sensitive material, such as amorphous selenium, a red highlight color image can be obtained when, for example, such an ambipolar photoresponsive device is charged positively, and developed with a negatively charged red colored developer composition a red image will result for those images of the original image corresponding to black and red. This red image could optionally be transferred to a suitable substrate such as paper, an intermediate surface, or such an image can be retained on the photoreceptor surface. In an immediately successive step, the photoresponsive device can be charged negatively and developed with a positively charged black developer composition, whereby a black image will result corresponding to the original black and blue images.

Other modifications of the present invention will occur to those skilled in the art upon a reading of the present disclosure, and these modifications are to be included within the scope of the present invention.

We claim:

1. An improved ambipolar photoresponsive device useful in imaging systems for the production of positive images from either positive or negative originals, comprised of:

(a) a supporting substrate, (b) a first photogenerating layer, (c) a charge transport layer, and (d) a second photogenerating layer, wherein the charge transport layer is comprised of a highly insulating organic resin having dissolved therein small molecules of an electrically active material of the formula:

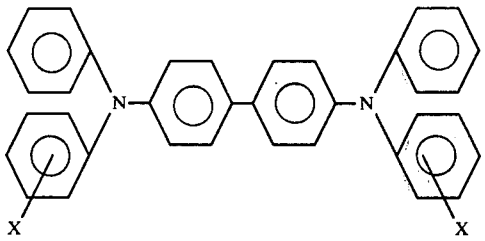

wherein X is selected from the group consisting of alkyl and halogen.

2. An improved photoresponsive device in accordance with claim 1 wherein X is ortho ($CH_3$), meta ($CH_3$), para ($CH_3$), ortho (Cl), meta (Cl), or para (Cl),

3. An improved photoresponsive device in accordance with claim 1 wherein the first photogenerating layer ranges in thickness of from about 0.05 microns to about 10 microns, the second photogenerating layer ranges in thickness of from about 0.05 microns to about 2 microns, and the transport layer ranges in thickness of from about 5 to about 30 microns.

4. An improved photoresponsive device in accordance with claim 1 wherein the photogenerating layers are selected from amorphous selenium, selenium arsenic alloys, selenium tellurium alloys, metal free phthalocyanines, metal phthalocyanines, and vanadyl phthalocyanine.

5. An improved photoresponsive device in accordance with claim 4 wherein the phthalocyanine is X-metal free phthalocyanine.

6. An improved photoresponsive device in accordance with claim 4 wherein the percentage by weight of selenium in the selenium arsenic alloy ranges from about 95 to about 100 percent, and the percentage by weight of arsenic ranges from about 5 to about 0 percent.

7. An improved photoresponsive device in accordance with claim 1 wherein the first photogenerating layer is comprised of vanadyl phthalocyanine, and the second photogenerating layer is comprised of an arsenic selenium alloy.

8. An improved photoresponsive device in accordance with claim 7 wherein the photogenerating materials are dispersed in an organic resin binder.

9. An improved photoresponsive device in accordance with claim 1 wherein the charge transport layer is N,N'-diphenyl-N,N'-bis(alkylphenyl)-[1,1,-biphenyl]-4,4'-diamine wherein alkyl is selected from the group consisting of 2-methyl, 3-methyl, 4-methyl, ethyl, propyl, butyl, and hexyl.

10. An improved photoresponsive device in accordance with claim 1 wherein the transport layer is N,N'-diphenyl-N,N'-bis(chlorophenyl)-[1,1'-biphenyl]-4,4'-diamine.

11. An improved photoresponsive device in accordance with claim 1 wherein the supporting substrate is conductive or insulating.

12. An improved photoresponsive device in accordance with claim 11 wherein the substrate is comprised of aluminum, or a polymeric substance.

13. An improved photoresponsive device in accordance with claim 11 wherein the substrate ranges in thickness of from about 3 mils to about 10 mils.

14. An improved photoresponsive device in accordance with claim 1 wherein the highly insulating organic resin is a polyester.

15. An improved method for providing positive images from either positive or negative originals, which comprises forming a latent electrostatic image on the photoresponsive device of claim 1, by positively charging the surface of the photoresponsive device, or negatively charging the surface of the photoresponsive device, contacting the image with developer particles comprised of carrier particles and toner particles, wherein the toner particles can be positively charged, or negatively charged, followed by transfer of the developed image to a suitable substrate and optionally, permanently affixing the images thereon.

16. An improved method in accordance with claim 15, wherein X is ortho ($CH_3$), meta ($CH_3$), para ($CH_3$), ortho (Cl), meta (Cl), or para (Cl).

17. An improved method in accordance with claim 16, wherein the first photogenerating layer ranges in thickness of from about 0.05 microns to about 10 microns, the second photogenerating layer ranges in thickness of from about 0.05 microns to about 2 microns, and the transport layer ranges in thickness of from about 5 microns to about 30 microns.

18. An improved method in accordance with claim 15 wherein the photogenerating layers are selected from amorphous selenium, selenium arsenic alloys, selenium tellurium alloys, metal free phthalocyanines, metal phthalocyanines and vanadyl phthalocyanine.

19. An improved imaging method in accordance with claim 18 wherein the phthalocyanine is X-metal free phthalocyanine.

20. An improved imaging method in accordance with claim 18 wherein the percentage by weight of selenium in the selenium arsenic alloy ranges from about 95 to about 100 percent, and the percentage by weight of arsenic ranges from about 5 percent to about 0 percent.

21. An improved imaging method in accordance with claim 15 wherein the first photogenerating layer is comprises of vanadyl phthalocyanine, and a second photogenerating layer is comprised of an arsenic selenium alloy.

22. An improved imaging method in accordance with claim 21 wherein the photogenerating materials are dispersed in an organic resin binder.

23. An improved imaging method in accordance with claim 15 wherein the charge transport layer is N,N'-diphenyl-N,N'-bis(alkylphenyl)-[1,1-biphenyl]-4,4'-diamine wherein alkyl is selected from the group consisting of 2-methyl, 3-methyl, 4-methyl, ethyl, propyl, butyl, and hexyl.

24. An improved imaging method in accordance with claim 15 wherein the transport layer is N,N'-diphenyl-N,N'-bis(chlorophenyl)-[1,1'-biphenyl]-4,4'-diamine.

* * * * *